United States Patent [19]

Calvert et al.

[11] 4,081,945

[45] Apr. 4, 1978

[54] PACKAGING MACHINE FOR USE WITH CARTONS OF DIFFERENT SIZES WITH MINIMUM ADJUSTMENT

[75] Inventors: Rodney K. Calvert, Dunwoody; Charles Rabun Landrum, Doraville, both of Ga.

[73] Assignee: The Mead Corporation, Dayton, Ohio

[21] Appl. No.: 742,056

[22] Filed: Nov. 15, 1976

[51] Int. Cl.[2] ..... B65B 43/28; B65B 7/20

[52] U.S. Cl. ..... 53/186; 53/201; 53/374; 53/381 R; 214/8.5 D; 271/99; 271/108

[58] Field of Search ..... 53/186, 201, 374, 381 R; 271/99, 100, 108, 136; 214/8.5 D

[56] References Cited

U.S. PATENT DOCUMENTS

| | | | |
|---|---|---|---|
| 2,756,553 | 7/1956 | Ferguson et al. | 53/186 X |
| 2,841,392 | 7/1958 | Norton | 271/108 |
| 2,909,874 | 10/1959 | Barr | 53/186 X |
| 3,002,750 | 10/1961 | Wheeler | 271/108 X |
| 3,030,869 | 4/1962 | Galloway | 53/186 X |
| 3,698,154 | 10/1972 | Woodruff et al. | 53/186 X |
| 3,802,696 | 4/1974 | Shigemori et al. | 271/108 X |

*Primary Examiner*—Othell M. Simpson
*Assistant Examiner*—Horace M. Culver
*Attorney, Agent, or Firm*—Walter M. Rodgers; Walter A. Rodgers

[57] ABSTRACT

A packaging machine includes oscillatable feeding means for withdrawing cartons from a hopper in sequence together with pusher means which engages withdrawn cartons and moves the cartons in sequence into cooperative relationship with conveyor means having transversely disposed spaced apart flight bars which move the cartons along a predetermined path so that leading end flaps of transversely disposed open ended cartons are disposed for engagement by static plows and so that a folding arm movable in a horizontal plane and through a clearance notch formed in each leading end flap may engage the immediately preceding trailing end flap so as to impart closing movement thereto. The machine may be readily converted for use with cartons of different sizes by suction means disposed on the oscillatable feeding means and arranged to provide suction pressure during every cycle or during alternate cycles only.

14 Claims, 6 Drawing Figures

LC
1
C1
12b
C3
12c
C4
12d
9
10
12
3
2
40a
18
42
46a
4
17
45c
15
45
45a
41
6
5
16
41b
47
13
8
7
41a
45b
41c
14
45d
EXHAUST
46
48b
43
50
51
48a
44
55
49
48
54
48c
VACCUM SUPPLY
AIR SUPPLY
56
53
52

LC
1
12a
C1
12b
12c
9
10
40a
12
3
2
18
42
46a
4
15
17
45
6
45a
41
5
16
41b
47
13
8
7
41a
45b
41c
14
EXHAUST
46
48b
51
48a
43
49a
49
50
44
55
48
54
48c
VACCUM SUPPLY
AIR SUPPLY
52
56
53

PACKAGING MACHINE FOR USE WITH CARTONS OF DIFFERENT SIZES WITH MINIMUM ADJUSTMENT

Wide spread proliferation of many sizes and shapes of primary packages requires that secondary packages such as sleeve type cartons of different sizes be provided. It is current practice to provide an end loaded sleeve type carton for packaging a dozen primary packages. Such cartons are also frequently provided for use in packaging two dozen primary packages. Machines which are constructed for loading and closing end loaded sleeve type cartons ordinarily are well suited for use with a carton of a particular predetermined size. Such machines require substantial modification in order to adapt them for use with cartons of the same type but of a different capacity.

According to this invention in one form, a machine is provided which includes oscillatable feeder means on which several suction cups are mounted for engaging in sequence and for withdrawing standard size cartons from a hopper and such mechanism is provided with means for applying vacuum pressure to the cartons during each operating cycle of the oscillatable means. According to one feature of the invention, the suction means is deactivated during alternate cycles of the oscillatable means so as to render the feeder means adaptable for use with cartons which are larger than standard size cartons. According to one facet of the invention, certain suction cups may be deactivated when the mechanism is used in conjunction with small cartons and reactivated for use with large cartons. In addition pusher means is provided and synchronized with conveyor means having spaced transversely disposed flight bars so that during feeding of standard size small cartons, two such cartons are moved into the space between two adjacent flight bars whereas a single large carton whose dimensions in the direction of movement along the conveyor having flight bars is twice that of the standard size smaller cartons so that a single larger carton may occupy the space between two adjacent flight bars. A folding arm according to another feature of the invention is arranged to swing through a clearance slot formed in each leading vertical end flap of each carton so as to engage the trailing vertical end flap of an immediately preceeding carton and thus to fold the trailing end flap toward closed position. If the machine is adjusted for use with large cartons, the folding arm simply idles at a position intermediate the leading and trailing edges of the larger cartons but of course the folding arm engages each trailing end flap of each carton whether the machine is used in conjunction with smaller type cartons in which two cartons for example are disposed between adjacent flight bars or with larger cartons when only one carton is disposed between adjacent flight bars.

For a better understanding of the invention, reference may be had to the following detailed description taken in conjunction with the accompanying drawings in which FIG. 1 is a somewhat schematically represented side view of a machine constructed according to this invention and which in solid lines depicts the feeding mechanism during an intermediate stage of a feeding operation adjusted for use in conjunction with small or standard sized cartons;

Figure 1:
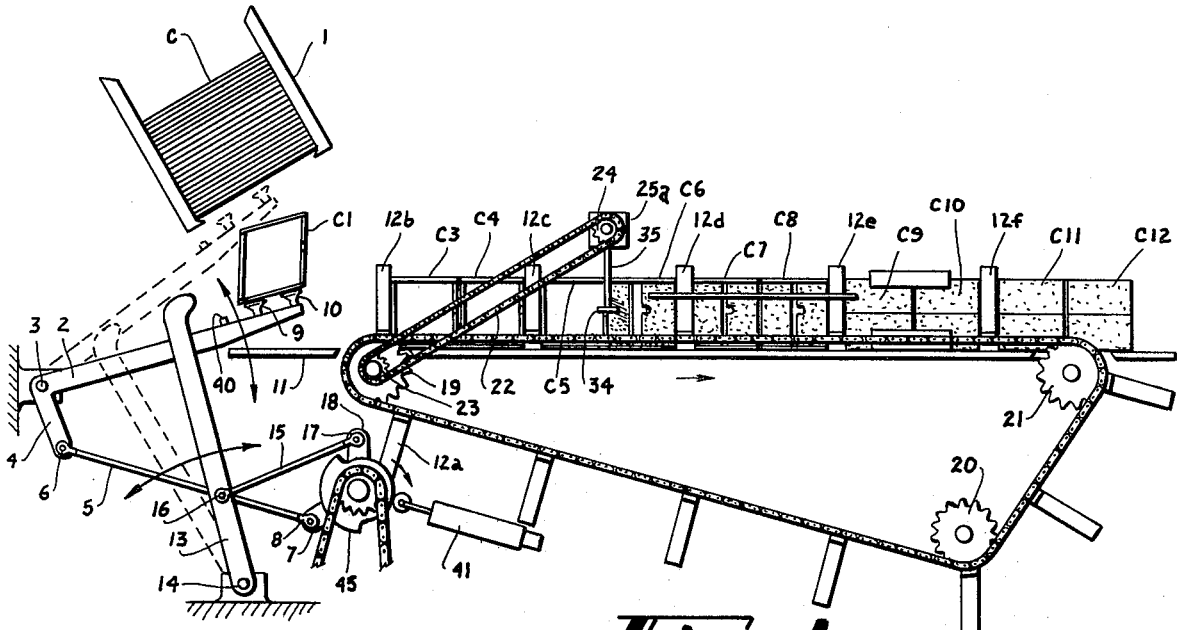
Figure 5:
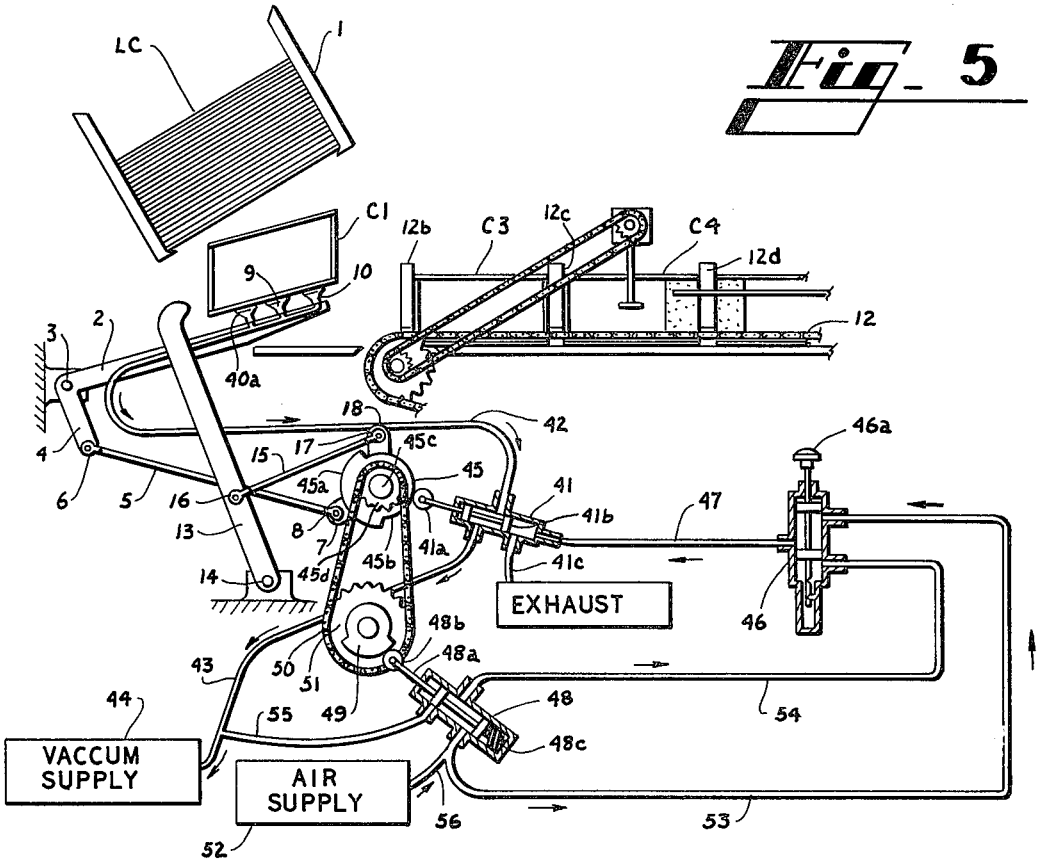
Figure 6:
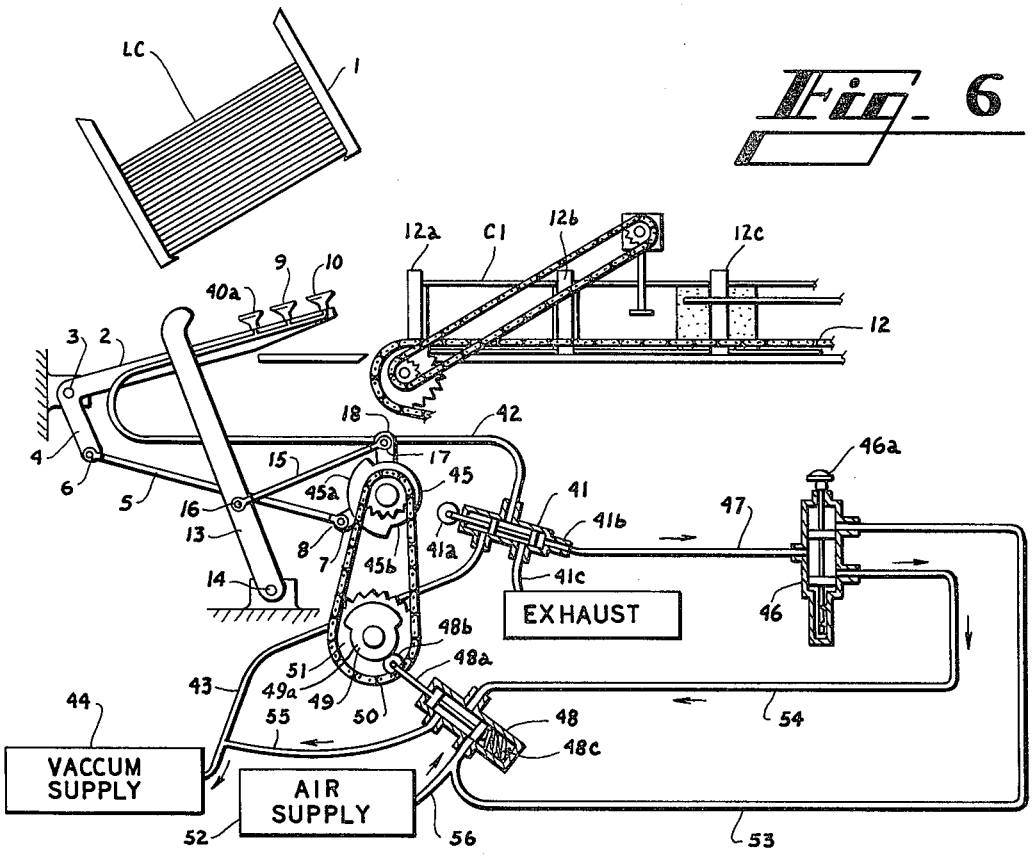

FIG. 5 is a schematic view similar to FIG. 1 but which shows the pneumatic system for applying vacuum and air under pressure to the main and control valves during a feeding cycle for a machine which applies suction during alternate cycles only and in which FIG. 6 is a view similar to FIG. 5 but which depicts the parts in the positions which they occupy during that part of a cycle of operation of the oscillatable feeding means during which vacuum pressure is cut off.

As shown for example in FIG. 1, the machine includes a hopper 1 in which a plurality of small or standard size cartons C are stacked. Oscillatable means in the form of arm 2 is pivoted at fixed pivot 3 and provided with crank arm 4 which is connected by link 5 and pin 6 to an operating crank 7 via pin 8. Driving crank 7 is rotated by means not shown in a clockwise direction. As is obvious, arm 2 oscillates to and fro about pivot 3 and its position adjacent the lowermost carton C in hopper 1 is designated by dotted lines.

For engaging and withdrawing the lowermost carton C from hopper 1, a plurality of suction cups 9 and 10 are provided and engage the lowermost carton C in known manner and withdraw the carton downwardly when the oscillatable arm 2 swings in a clockwise direction about pivot 3. A withdrawn partially set up carton is indicated at C1 and is deposited atop stripper plate 11 in known manner in coordination with the release of vacuum pressure.

For the purpose of moving a carton such as C1 from stripper plate 11 onto conveyor 12 and intermediate flight bars such as 12*a* and 12*b*, a pusher arm 13 is provided and is pivoted to fixed pivot 14. Pusher arm 13 is oscillated to and fro about pivot 14 by connecting rod 15 which is pivoted at 16 to pusher arm 13 and which is pivoted at its other end at pin 17 to rotatable crank 18. Crank 18 is rotated in a clockwise direction by means not shown but which is well known. As is indicated in FIG. 1, in solid lines the pusher 13 occupies an intermediate position and upon movement into engagement with carton C1 causes that carton to move from stripper plate 11 onto conveyor 12 and to a position immediately adjacent and behind flight bar 12*b*.

During a succeeding operation of oscillatable arm 2 and pusher arm 13, a succeeding carton is moved behind carton C1 and immediately in front of flight bar 12*a*. During a subsequent phase of the operation, two cartons occupy positions designated at C3 and C4 between flight bars 12*b* and 12*c*. Similarly cartons C5–C12 are disposed along the working reach of conveyor 12 as shown in FIG. 1.

Figure 2:
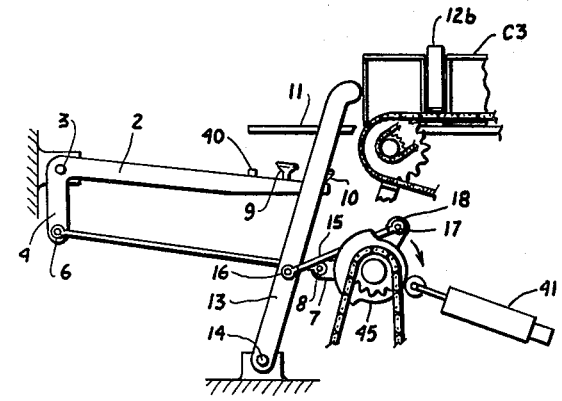
FIG. 2 is a view of a portion of the left hand end of FIG. 1 and shows the parts in solid lines in the positions which they occupy upon completion of a feeding operation.

FIG. 2 shows the pusher arm 13 in the position which it occupies upon completion of a feeding operation such as that effected in conjunction with a carton such as is designated at C4. Conveyor 12 is driven by driving sprocket 19 and the conveyor is disposed about idler sprockets 20 and 21 in known manner. Operating movement is imparted to driving sprocket 19 by means of driving chain 22 which cooperates with sprockets 23 and 24. Sprocket 24 is driven from a gear box 25 in known manner by means not shown.

The working reach of conveyor 12 extends horizontally from sprocket 19 to sprocket 21 and defines a predetermined path along which the cartons on the conveyor and between the flight bars are loaded and their end flaps closed. Preferably the loading operation is effected in the region at which the cartons C3, C4 and C5 are disposed as indicated in FIG. 1.

Figure 3:
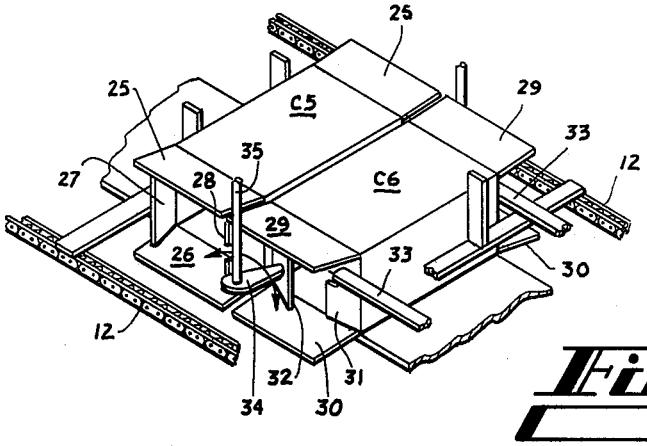
FIG. 3 is a perspective view of a pair of standard size small cartons which illustrates the closing of the leading and trailing end flaps.

Following completion of a loading operation through the open ends of the cartons, the end flaps must be closed. As is best shown in FIG. 3 in conjunction with cartons C5 and C6, carton C5 is provided with top end flaps 25 and bottom end flaps 26 only one of which is observable in FIG. 3. In addition carton C5 includes trailing end flap 27 only one of which is observable in FIG. 3 together with a leading end flap 28 only one of which is observable in FIG. 3. Similarly carton C6 includes top end flaps 29 and bottom end flaps 30. Leading end flaps 31 and trailing end flaps 32 are associated with carton C6. Leading end flap 28 of carton C5 and trailing end flap 32 of carton C6 are in close proximity with each other when the elements occupy the positions shown in FIG. 3.

As is well known, upper and lower flaps such as 29 and 30 of carton C6 may be folded into closed position downwardly and upwardly respectively by known static plows not shown in the drawings. Similarly static plows such as those indicated at 33 in FIG. 3 may conveniently be employed to fold the leading end flaps such as 28 and 31 into closed position.

As is well understood, static plows as such are not suitable for performing a complete folding operation of trailing end flaps such as 27 of carton C5 trailing flap 32 of carton C6.

In order to fold the trailing end flaps, a folding arm 34 is provided on each side of the path of movement of the cartons and preferably is supported by a substantially vertical oscillatable shaft 35 which is oscillated by known means such as gear box 25*a*.

In order to provide clearance between the leading end flap 28 of carton C5 and folding arm 34, a clearance notch 36 is formed in the leading end flap 28 of carton C5 so that arm 34 may swing in a clockwise direction as viewed from above through the clearance slot 36 and into engagement with trailing flap 32 of carton C6. This swinging movement of folding arm 34 causes the trailing flap 32 of carton C6 to fold approximately to the position indicated in FIG. 3. Thereafter static flight bar 33 engages the trailing flap 32 and completes the folding of that flap into closed position. Following this operation static plows not shown in the drawings fold top end flap 29 downwardly into overlying relationship with respect to leading end flap 31 and trailing end flap 32 and bottom end flap 30 is folded upwardly by static plows into flat face contacting relation with the leading end flap 31 and the trailing end flap 32 so that upon completion of this operation the closing of the carton is substantially complete. Of course suitable applications of glue are made so as to effect a proper bond in known manner. If desired, the end flaps may be secured by other known means such as locks.

Following the glueing operation, the carton is complete and the completed cartons are fed toward the right through the positions designated in FIG. 1 at C11 and C12. The so-called standard size or small cartons C which are depicted in FIGS. 1, 2 and 3, do not require as many suction cups as do larger cartons. For this reason, only the mounting sockets for a row of suction cups is depicted at 40 in FIG. 1. These mounting sockets may simply be sealed off by any suitable means when the machine is used in conjunction with small cartons as depicted in FIGS. 1–3.

Figure 4:
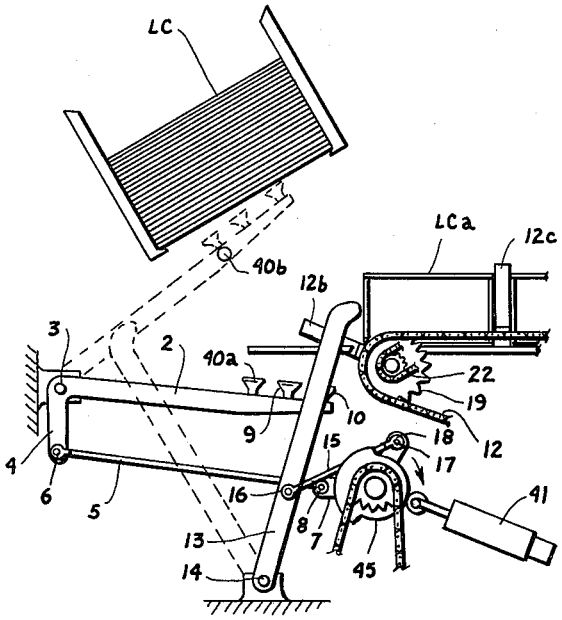
FIG. 4 is a view similar to FIG. 2 but which depicts the machine in conjunction with larger cartons, certain dimensions of which are multiples of the corresponding dimensions of the smaller cartons shown in FIG. 2.

When the machine is used in conjunction with larger cartons such as are designated at LC in FIG. 4, a full complement of suction cups is employed and such suction cups are designated in FIG. 4 by the numerals 9, 10 and 40*a*. It will be understood that suction cup 40*a* need not be physically removed as indicated in FIG. 1 but simply may be sealed off by means of a closure element such as 40*b* which is threaded into an appropriate hole on oscillatable operating arm 2. Larger cartons LC are twice as large as smaller cartons C in the direction of movement along the working reach of conveyor 12 and hence occupy the entire space between adjacent flight bars such as 12*b* and 12*c* as indicated at LC*a*.

Since half as many of the larger cartons LC can be accommodated by the conveyor 12 as compared to the smaller cartons C, it is necessary in the illustration shown in FIG. 4 to feed one half as many of the larger cartons LC in a given time interval. This is accomplished according to one facet of the invention by simply shutting off the vacuum pressure to suction cups 9, 10 and 40*a* during alternate cycles. Thus while the oscillatable arm 2 and the pusher 13 continue to operate in the manner described in connection with FIGS. 1 and 2, suction pressure is not applied during each cycle but rather is applied only during alternate cycles. The arrangement shown in FIG. 5 depicts conditions during a feeding cycle when the machine is adjusted for use with large cartons LC while FIG. 6 depicts conditions during the alternate or non-operating cycle when the machine is adjusted so as not to feed a carton LC.

As is shown in FIG. 5 in connection with a feeding cycle, a cam operated main valve 41 is interconnected by conduit 42 with suction cups 9, 10 and 40*a*.

Main valve 41 is connected by conduit 43 with a vacuum source schematically represented at 44. Main valve 41 is operated by cam 45 having raised portion 45*a* and lower portion 45*b*. A cam follower 41*a* is provided on the stem of main valve 41 and follows cam 45 during the rotation thereof by shaft 45*c*. Shaft 45*c* also drives arms 7 and 18 in unison with the cam 45.

A pneumatic system includes manually operable control valve 46 having manual button 46*a*. Valve 46 is connected with main valve 41 via conduit 47. Pneumatic means also includes a cam actuated control valve 48 on whose stem 48*a* a cam follower 48*b* is mounted to ride on cam 49 driven by chain 50 and sprocket 51. Sprocket 51 is twice the diameter of sprocket 45*d* so that for each revolution of shaft 45*c* and of sprocket 45*d*, sprocket 51 and its associated cam 49 rotate one half revolution. Thus cam actuated valve 48 operates one half as many times in a given time interval as does main valve 41 and only during alternate cycles. Manually operated valve 46 is interconnected with air supply source schematically represented at 52 by a bypass conduit 53 which bypasses cam actuated control valve 48. A conduit 54 interconnects cam actuated control valve 48 and manually actuated control valve 46. Similarly a conduit 55 interconnects the vacuum source 44 with cam actuated control valve 48.

Cam actuated control valve 48 is provided with a compression spring 48*c* which causes the cam follower 48*b* to maintain constant contact with the cam 49. It should be pointed out that main valve 41 is not provided with a spring such as 48c. Instead this valve is supplied with pressure which bears against the piston 41b to urge the cam follower 41a into contact with the surfaces of cam 45. When pressure is relieved in the main valve 41 and is then applied to piston 41b, the cam follower 41a rides along the cam surface 45a but does not engage the lower cam surface 45b.

With the units in the positions depicted in FIG. 5, vacuum pressure is applied from the vacuum source 44 through the conduit 43 and the sequentially operable main valve 41, conduit 42 to the suction cups 9 and 10 when the roller 41a rides on the lower surface 45b of cam 45 as shown in FIG. 5. The roller 41a is maintained in the position shown in FIG. 5 by pressure fluid supplied through conduit 47, manually operable control valve 46, conduit 54, cam actuated control valve 48, and conduit 56 from the air supply 52, the pressure of which is in excess of atmospheric pressure. This pressure causes cam follower 41a to follow the cam 45 and during each rotation thereof turns the vacuum on and off as required. For example during a carton withdrawing operation the vacuum is on and the parts occupy the positions shown in FIG. 5. When the cam follower 41a rides on the upraised portion 45a of the cam 45, main valve 41 is closed with its cam follower 41b moved toward the right so as to shut off and to isolate the vacuum in conduit 43 from conduit 42 and from suction cups 9 and 10 while allowing atmospheric air to enter port 41c, conduit 42 and cups 9 and 10. It should be noted that the valve button 46a is in its depressed position in both FIGS. 5 and 6.

FIG. 6 as explained also represents the depressed condition of valve button 46a but shows the cam follower 41a spaced from the cam 45 because no pressure above atmospheric pressure is applied to the right hand end of main valve piston 41b. This condition is due to the fact that the cam 49 has rotated one half revolution during a complete revolution of cam 45 as shown in FIG. 6. This operation, due to the action of spring 48c, causes the cam follower 48b to move onto the lower portion 49a of cam 49. This action effectively interconnects vacuum conduit 55 through valve 48 and conduit 54, through manually operable control valve 46 with conduit 47 so that vacuum pressure is applied to the piston 41b in main valve 41. This action precludes the cam follower 41a from following the cam 45 and thus effectively closes the valve 41 and isolates the vacuum in conduit 43 from conduit 42 and connects conduit 42 to atmosphere. Of course with no vacuum in conduit 42 no vacuum is available in suction cups 9, 10 and 40a. Thus during the engagement of suction cups 9 and 10 with the lowermost carton LC in hopper 1, a carton is not withdrawn and the oscillatable arm 2 simply idles without any effective withdrawal during the portion of the cycle represented by FIG. 6. It is by this means that one half the number of larger cartons are fed according to the arrangement represented in FIGS. 4, 5 and 6 as are fed by the arrangement represented in FIGS. 1, 2 and 3.

Since each of the larger cartons LC occupies the same space as that which normally is occupied by small cartons such as C3 and C4 in FIGS. 1–3, for example, the trailing end flaps such as are designated at 32 on carton C6 and the leading end flaps such as are designated at 28 on carton C5 can be considered as nonexistent in connection with the arrangements of FIGS. 4, 5 and 6. Under these conditions, the oscillatable vertical shaft 35 and the folding arm 34 simply idle and oscillate to and fro without engaging any end flaps in the region intermediate the leading and trailing edges of a large carton LC which is the space equivalent of two small cartons C5 and C6. Of course the parts are operated in synchronism so that the action described above in connection with the smaller cartons such as C3 and C4 occurs to allow the end of folding arm 34 to swing through a clearance notch such as indicated at 36 and which is formed in the leading end flap of a large carton LC to allow the folding arm 34 to engage a trailing end flap on a larger carton LC such as that designated at 32 in FIG. 3 in connection with the small carton C6.

In order to preclude alternate deactivation of the vacuum cups such as 9 and 10 and to insure proper application of vacuum during each oscillation of oscillatable arm 2 and of oscillatable pusher arm 13, the button 46a is simply elevated to a position not represented in FIGS. 5 and 6 but which effectively interconnects the piston 41b of main valve 41 through conduit 47, valve 46, and bypass conduit 53 with the air supply under pressure schematically represented at 52 to cause the stem of valve 41 to move toward the left and thus to cause cam follower 41a to follow the cam surfaces 45a and 45b of cam 45. Under these conditions the main valve 41 operates to supply suction on and off during each operating cycle, that is during each oscillation of oscillatable feeding arm 2 and of oscillatable pusher arm 13. The change over for cartons of different sizes is thus simplified and requires the simple activation manually of push button 46a.

While the drawings show cartons LC which are twice the size of cartons C in the direction of feed, it is obvious that other dimensional multiples may be employed without departing from the spirit and scope of the invention.

The embodiments of the invention in which an exclusive property or privilege is claimed are defined as follows:

1. A machine for feeding cartons from a hopper, said machine comprising oscillatable means movable sequentially toward and away from the hopper, suction means mounted on said oscillatable means and movable therewith for engaging and withdrawing cartons in sequence from the hopper, main valve means for activating and for deactivating said suction means in synchronism with said oscillatable means, cam means movable in synchronism with said oscillatable means for controlling the operation of said main valve means, and pneumatic means connected with said main valve means for controlling cooperation between said main valve means and said cam means.

2. A machine according to claim 1 wherein said suction means comprises a plurality of suction cups interconnected with a vacuum source, and means for isolating a predetermined one or more of said suction cups from said source.

3. A machine according to claim 1 wherein said pneumatic means includes a manually operable control valve arranged to supply suction pressure or pressure in excess of atmospheric pressure to said main valve.

4. A machine according to claim 3 wherein a synchronously operable control valve is interconnected between said manually operable control valve and a source of vacuum pressure and wherein said synchronously operable control valve supplies vacuum pressure at intervals to said main valve through said manually operable control valve when said manually operable control valve is adjusted to supply vacuum pressure to said main valve.

5. A machine according to claim 3 wherein a synchronously operable control valve is interconnected between said manually operable control valve and a source of pressure in excess of atmospheric pressure and wherein said synchronously operable control valve supplies pressure in excess of atmospheric pressure at intervals to said main valve through said manually operable control valve when said manually operable control valve is adjusted to supply pressure from said source of pressure in excess of atmospheric pressure.

6. A machine according to claim 5 wherein a bypass conduit is interconnected from said source of pressure in excess of atmospheric pressure to said manually operable control valve so as to bypass said synchronously operable control valve and to supply pressure to said main valve when said manually operable control valve is adjusted to supply pressure from said bypass conduit to said main valve.

7. A machine for feeding sleeve type cartons having end flaps from a hopper and for loading and closing the end flaps the leading ones of which include a clearance slot, said machine comprising oscillatable means movable sequentially toward and away from the hopper, suction means mounted on said oscillatable means and movable therewith for engaging and withdrawing cartons in sequence from the hopper, and means for rendering said suction means ineffective during preselected oscillations of said oscillatable means without interfering with said suction means during other oscillations of said oscillatable means, means for moving the cartons along a predetermined path, means for loading the cartons, and a folding arm arranged to swing through the clearance slot of each leading end flap and into engagement with the trailing flap of an adjacent immediately preceding carton for closing said trailing flap.

8. A machine according to claim 7 wherein said folding arm is mounted on a substantially vertical shaft and arranged to swing in a horizontal plane.

9. A machine according to claim 8 wherein said shaft is arranged to oscillate in synchronism with movement of the cartons along said predetermined path.

10. A machine according to claim 7 wherein said folding arm swings at an effective velocity which is greater than that at which the cartons move along said predetermined path.

11. A machine according to claim 7 wherein static plows are arranged to engage and fold the leading end flaps and to engage the trailing end flaps following initial folding thereof by said folding arm.

12. A machine for closing the end flaps of standard sized sleeve type cartons in which a clearance slot is formed in the leading end flaps thereof, comprising means for moving the cartons along a substantially horizontal predetermined path and in transverse relation thereto, a folding arm disposed on each side of the predetermined path and arranged to swing in a substantially horizontal plane through the clearance slot in each leading end flap and into engagement only with the trailing end flap of an immediately preceding carton so as to impart swinging closing movement thereto, pusher means for sequentially engaging cartons withdrawn from a hopper and for moving the cartons to said means for moving the cartons along a predetermined path, said moving means comprising conveyor means including transverse spaced apart flight bars for sequentially engaging and moving the cartons, the spacing between adjacent flight bars being approximately a multiple of the carton dimension in the direction of travel, and means for rotating said folding arms a number of revolutions between said flight bars equal to said multiple of the carton dimension.

13. A machine according to claim 12 wherein static plows are arranged to engage and close the leading end flaps of the cartons and also to engage the trailing end flaps following initial folding thereof by said folding arms.

14. A machine according to claim 12 wherein said folding arms are adapted to operate on larger cartons whose dimensions in the direction of movement along said predetermined path are multiples of the corresponding dimensions of said standard sized cartons and wherein idling movement of said folding arms occurs intermediate the leading and trailing end flaps of each larger carton.

* * * * *